US007127837B2

(12) United States Patent
Ito

(10) Patent No.: US 7,127,837 B2
(45) Date of Patent: Oct. 31, 2006

(54) SHOE WHOSE UPPER IS HORIZONTALLY OPENABLE/CLOSABLE FROM THE SIDE BY MEANS OF A SLIDE FASTENER

(75) Inventor: Hiromi Ito, Meguro-ku (JP)

(73) Assignee: Fairberish, Tokyo (JP)

( * ) Notice: Subject to any disclaimer, the term of this patent is extended or adjusted under 35 U.S.C. 154(b) by 8 days.

(21) Appl. No.: 10/707,473

(22) Filed: Dec. 17, 2003

(65) Prior Publication Data

US 2004/0118019 A1 Jun. 24, 2004

(30) Foreign Application Priority Data

Dec. 18, 2002 (JP) ..... 2002-366103

(51) Int. Cl.

| | |
|---|---|
| ***A43B 3/24*** | (2006.01) |
| ***A43B 3/28*** | (2006.01) |
| ***A43B 3/30*** | (2006.01) |
| ***A43B 1/02*** | (2006.01) |
| *A43B 3/10* | (2006.01) |

(52) U.S. Cl. ..... 36/101; 36/112; 36/9 R; 36/45

(58) Field of Classification Search ..... 36/101, 36/100, 97, 112, 7.1 R, 9 R, 12 R, 12, 15, 36/140, 76 C, 45

See application file for complete search history.

(56) References Cited

U.S. PATENT DOCUMENTS

| | | | | |
|---|---|---|---|---|
| 2,444,640 | A * | 7/1948 | Epstein | 36/101 |
| 2,686,376 | A * | 8/1954 | Burkholz | 36/101 |
| 4,067,124 | A * | 1/1978 | Rys-Sikora et al. | 36/45 |
| 4,333,248 | A * | 6/1982 | Samuels | 36/101 |
| 4,628,622 | A * | 12/1986 | McBarron | 36/112 |
| 4,665,634 | A * | 5/1987 | Diaz | 36/112 |
| 4,745,693 | A * | 5/1988 | Brown | 36/101 |
| 5,727,334 | A * | 3/1998 | Cougar | 36/15 |
| 5,950,333 | A * | 9/1999 | Tsen | 36/7.1 R |
| 5,983,528 | A * | 11/1999 | Hartung | 36/15 |
| 6,557,273 | B1 * | 5/2003 | Polifroni | 36/44 |
| 6,874,256 | B1 * | 4/2005 | Delgatty | 36/100 |
| 2003/0009916 | A1 | 1/2003 | Bernstein | |
| 2004/0194349 | A1 * | 10/2004 | Delgatty | 36/101 |

FOREIGN PATENT DOCUMENTS

| | | |
|---|---|---|
| DE | 6604594 U | 1/1970 |

(Continued)

*Primary Examiner*—Anthony Stashick
(74) *Attorney, Agent, or Firm*—Judge & Murakami IP

(57) ABSTRACT

The invention provides shoes for the elderly and disabled that are easy to put on and remove, that fit comfortably, and that are fashionable. This invention is a shoe with a slide fastener that zips open horizontally along the edge of the upper, with the upper being detachable along the edge of the outsole from the outside of the ankle to the base of the big toe, and with a slide fastener that is attached horizontally along the edges of the upper and the outsole from the base of the big toe to the outside of the ankle. Fastening tapes A and C (hook strips) are attached at the pull-tab of the slide fastener and the edge of upper, respectively, and second fastening tape (loop strip) is attached at the quarter in line with the other hook strips. A composite of polychloroprene rubber foam glued together with synthetic fabric is used as material for the upper. An ornamental design made of the same material as the upper, but in different color and texture, is attached to the upper. The shoe uses a slide fastener with a water-resistance of 0.01 kgf/cm$^2$ or more.

13 Claims, 10 Drawing Sheets

FOREIGN PATENT DOCUMENTS

| | | | |
|---|---|---|---|
| DE | 9311441 | U | 10/1993 |
| FR | 2617379 | A | 1/1989 |
| JP | S55-098210 | | 7/1980 |
| JP | S57-137303 | | 8/1982 |
| JP | S61-066501 | | 5/1986 |
| JP | 2002-177001 | A | 6/2002 |

* cited by examiner

SHOE WHOSE UPPER IS HORIZONTALLY OPENABLE/CLOSABLE FROM THE SIDE BY MEANS OF A SLIDE FASTENER

BACKGROUND OF INVENTION

1. Technical Field

The present invention relates to shoes that are easily put on and taken off and are comfortable to wear. In particular, the invention relates to shoes that for the elderly and for persons who by some cause are physically disabled are easily put on and taken off and that are comfortable to wear. The invention further relates to shoes that are easy for caregivers to put on nursing care recipients.

2. Description of the Related Art

These kinds of shoes have been available in the past. One example is a shoe for nursing care recipients, as disclosed in Japanese Unexamined Pat. App. Pub. No. 2002-262906. This shoe is shown in FIG. 7 as a first conventional example. FIG. 7A is an oblique view showing the shoe with fastening tape 31 attached to the underside of the belt 32, and complementary fastening tape 31 corresponding to the tape on the belt 32 and attached to the vamp in order to open and close the shoe. FIG. 7B is an oblique view showing the shoe on a foot. This shoe has a V-shaped slit from the instep to the toe, fastening tape 31 attached to the right and left sides of the slit, and a belt 32 with fastening tape 31 attached to its underside, so that the shoe may be opened or closed on the right or left side by attaching the belt 32 to the right or left side of the vamp.

A second example is a shoe for rehabilitation, disclosed in Japanese Unexamined Pat. App. Pub. No. 2001-46109, that consists of a shoe with a vamp, all or part of which is covered with a fastener surface, and a separate fastening belt with first fastening tape attached to its underside.

This shoe is shown in FIG. 8 as a second conventional example. FIG. 8A is an oblique view showing the shoe with a vamp that functions as the pile part of a hook-and-pile fastener 41, and a separate fastening belt 42 with the hook part of the hook-and-pile fastener 43 attached to its underside. FIG. 8B is an oblique view showing a foot in the shoe with the fastening belt 42 fastened.

A third example is a shoe with a vamp that has a belt attached to one side and an open section in the center with a flap attached to the lower end of the open section, as disclosed in Japanese Unexamined Pat. App. Pub. No. 2001-104012. The top of the flap and surface of the vamp are made of loop fabric. Hook fabric is attached to the edges of the underside of the flap and to the end of the underside of the belt so that the flap may be fastened to the vamp and the belt may be fastened to the vamp over the top of the flap.

This shoe is shown in FIG. 9 as a third conventional example. FIG. 9 is an oblique view of the shoe with a belt 51 and flap 52, showing the belt 51 and the flap 52 with hook fabric 53 (the hook part of a hook-and-pile fastener) attached to the undersides, the belt 51 and flap 52 unfastened, and the front part completely open.

A fourth example is a shoe for the elderly and the disabled that uses a slide fastener (or zipper) attached to a slit along either side of the eyelets for shoelaces, as disclosed in Japanese Unexamined Pat. App. Pub. No. 2001-104010. When the wearer puts on the shoe for the first time, the slide fasteners are kept fastened and the shoelaces are loosened. The shoelaces are then tightened to fit the shoe to the wearer's foot. Subsequently, the wearer may put on and remove the shoes by simply fastening and unfastening the slide fasteners.

This shoe is shown in FIG. 10 as a fourth conventional example. FIG. 10A is an oblique view of the shoe with slide fasteners 61 at both sides of the shoelaces 62. FIG. 10B is an oblique view of the shoe with a slide fastener 61 unzipped to open out the cuff. FIG. 10C is an oblique view showing the slide fastener 61 being fastened.

Although the conventional shoes described above each in their own way demonstrate a certain effectiveness, for the elderly and the disabled in particular, putting on and removing these shoes is a hard task, such that they are still inadequate in terms of ease of wear.

It is difficult for elderly or disabled persons to put on shoes while seated because they have to push feet that may be swollen or painful into fixed-shaped shoes and then push their heels in place as well.

SUMMARY OF INVENTION

Therefore, an object of the present invention is to provide shoes with a comfortable fit that are easy for elderly and disabled persons to put on and remove.

An additional object of the present invention is to provide shoes that are easy for care-givers to put on persons who receive care or shoes that are easy for care-givers to help those persons put on. This object is particularly important given the aging population and declining birthrate.

This invention is primarily characterized by a shoe with a slide fastener that zips open horizontally along the edge of an upper that is unilaterally split between the quarter and vamp, with the upper being detachable along the edge of the outsole from the outside of the ankle to the base of the big toe, and with the slide fastener being attached to the edges of the upper and the outsole from the base of the big toe to the outside of the ankle.

Accordingly, the upper of the shoe zips open along the edge of the shoe from the big toe to the outside of the ankle, making it easy to put the shoe on by simply placing the foot on the insole of the shoe. The slide fastener can be easily zipped open, even with one hand.

The shoe combines the horizontal slide fastener with first fastening tape on the outer ankle, enabling the wearer to put on and remove the shoe easily and also to hold the foot firmly in the shoe.

A composite of polychloroprene rubber foam glued together with synthetic fabric is used as material for the upper.

The insole core, which is made of a hard plastic, along its underside has a heel area gently sloping rearward and is therein slightly thicker in the rearward portion of the insole. Therefore, the shoes fit comfortably.

In addition, the shoes use a slide fastener with a water-resistance of 0.01 $kgf/cm^2$ or more, enabling the shoe to resist water on rainy days, even though the slide fastener is attached horizontally at the bottom edge of the shoe.

A first aspect of the present invention is a shoe with a slide fastener that zips open horizontally along the edge of an upper that is unilaterally split between the quarter and vamp, with the upper being detachable along the edge of the outsole from the outside of the ankle to the base of the big toe, and with the slide fastener being attached to the edges of the upper and the outsole from the base of the big toe to the outside of the ankle.

A second aspect of the present invention is a shoe with a slide fastener that zips open horizontally along the edge of an upper that is unilaterally split between the quarter and vamp, with the upper being detachable along the edge of the outsole from the outside of the ankle to the base of the big toe, and with the slide fastener being attached to the edges of the upper and the outsole from the base of the big toe to the outside of the ankle, and with a first fastening tape that is attached to the pull-tab of the slide fastener, and a complementary second fastening tape that is attached to the quarter to correspond to the first tape.

Although the first fastening tape may be attached to the pull-tab of the slide fastener by any method of choice, the pull-tab itself is preferably formed as the first fastening tape.

The second fastening tape is sewn in a well-known way onto the outside of the quarter, where it corresponds to the first fastening tape.

Putting on and removing the shoe is facilitated because only the first fastening tape, provided on the slide-fastener pull-tab, need be manipulated. This is particularly suited to shoes for indoor wear.

A third aspect of the present invention is a shoe with a slide fastener that zips open horizontally along the edge of an upper that is unilaterally split between the quarter and vamp, with the slide fastener being attached to the edges of the upper and the outsole from the base of the big toe to the outside of the ankle, and with a first fastening tape that is attached to the pull-tab of the slide fastener, and complementary second and third fastening tapes attached respectively to the quarter and the split part of the upper.

The third fastening tape is sewn in a well-known way to an inside part of the split in the upper, corresponding to the second fastening tape on the quarter. With the third fastening tape fastened to the second fastening tape, the upper is firmly fixed to the heel part of the quarter. This is particularly suited to shoes for outdoor wear.

A fourth aspect of the present invention is a shoe with a slide fastener that zips open horizontally along the edge of the upper, as described in the first, second, and third aspects, and with the upper being composed of material that is a composite of polychloroprene rubber foam glued together with synthetic fabric on one side or on both sides.

A variety of materials may be used for the uppers of shoes, but the invention uses a particular composite of polychloroprene rubber foam glued together with synthetic fabric on one side or both sides to achieve water resistance, a water-shedding quality, elasticity, flexibility, and breathability.

Polychloroprene rubber foam is widely known as Neoprene (registered trademark of DuPont Dow elastomers, hereinafter referred to as "registered trademark"). Polychloroprene rubber foam is on the market in a variety of Neoprene™ sponges. This invention uses a composite of Neoprene™ sponge glued together by laminating or like means with a synthetic fabric, such as nylon jersey, on one side or on both sides.

Hereinafter, this material is referred to as Neoprene™ composite.

A variety of materials may be used for the outsoles of shoes, but this invention uses Neoprene™ synthetic rubber because of its suitability with the material of the upper. In particular, the transparent silicon rubber outsole is preferable from a design viewpoint.

A fifth aspect of the present invention is the shoe with a slide fastener that zips open horizontally along the edge of the upper, as described in the first, second, third and forth inventions, with an insole consisting of an insole core and an insole cover, with the insole core being made of hard-plastic, and along its underside having a heel area gently sloping rearward and is therein slightly thicker in its rearward portion of, and with the insole cover being made of a washable fabric that is removable from the insole core.

The insole core is characterized by a hard material rather than the soft material, such as urethane foam or other rubbery material, used for a traditional insole. In this invention, because hard material is used for the insole core, a hard plastic may used. For example, a hard resin such as polypropylene would be suitable for the insole core.

Taking into consideration the ankles of the elderly, a slight slope of almost 3 degrees of is used to lift the heel slightly, making the shoe more comfortable.

Fabric options for use as material for the insole cover include cotton, which is preferable. A cotton insole cover is washable, like a pair of socks. In addition, the plastic insole core can be easily wiped clean with a damp cloth. These features enable wearers and care-givers to keep the shoes clean, particularly when the shoes are worn for long periods of time by recipients of nursing care.

A sixth aspect of the present invention is the shoe with a slide fastener that zips open horizontally along the edge of the upper, as described in the first, second, third, forth, and fifth inventions, with the slide fastener being water-resistant to 0.01 kgf/cm$^2$ or more.

The slide fastener is optional for the first, second, third, forth and fifth inventions because the shoes may be worn indoors without the slide fastener.

However, when the shoes are worn outdoors, they must be suitable for use in the rain. Therefore, in order to keep out the water, the slide fastener is water-resistant to 0.01 kgf/cm$^2$ or more. A slide fastener with this level of water resistance is already used in wetsuits, belt-bags for marine sports, tank packs for motorcycles, dry bags, and other products currently on the market.

From the following detailed description in conjunction with the accompanying drawings, the foregoing and other objects, features, aspects and advantages of the present invention will become readily apparent to those skilled in the art.

DETAILED DESCRIPTION

Embodiment 1

Figure 1:
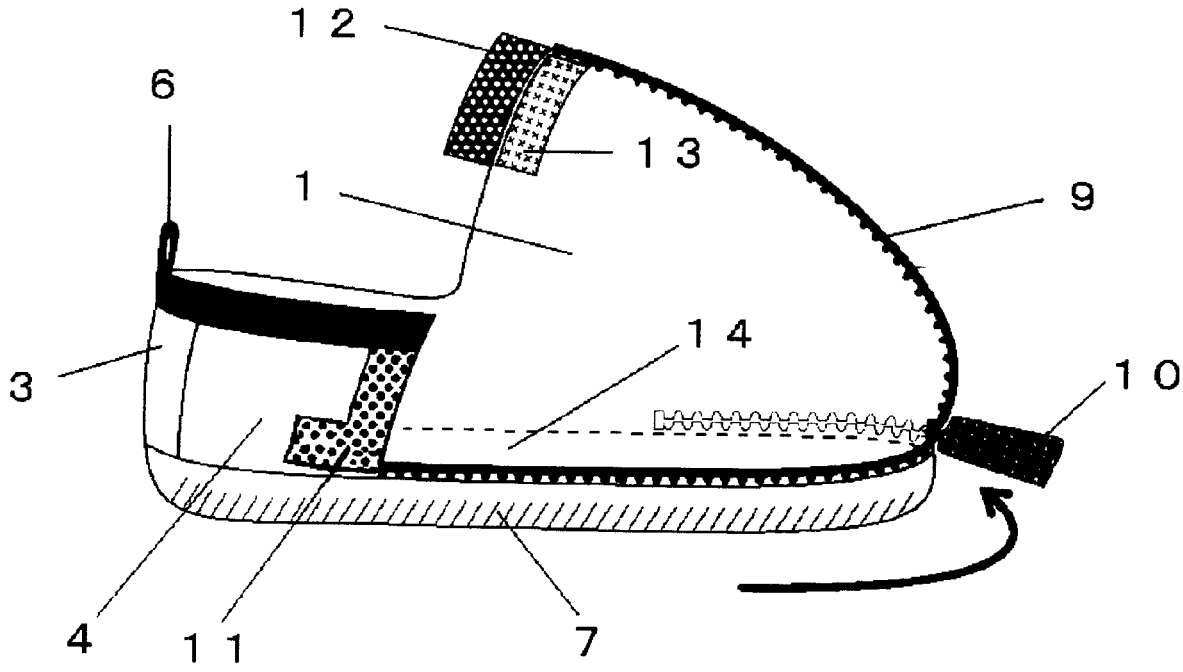
FIG. 1 is an oblique side view of a right shoe in Embodiment 1 of the present invention, showing the upper of the shoe half-unzipped to the middle of the toes.

The following detailed description deals with Embodiment 1 of the present invention according to FIG. 1. However, the invention is not limited to Embodiment 1. FIG. 1 is an oblique side view showing a right shoe half-unzipped to the middle of the toes.

Figure 2A:
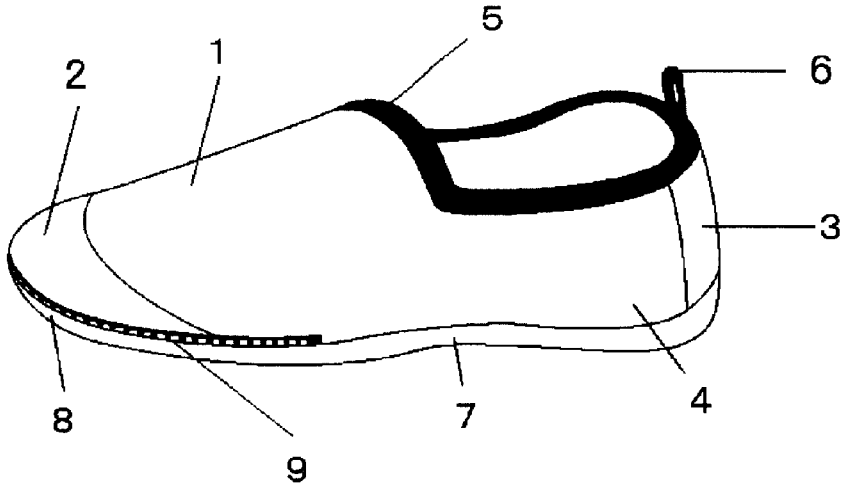
FIG. 2 includes an oblique view 2A of the left side of a right shoe in Embodiment 1 of the present invention, and an oblique view 2B of the top of the shoe, showing the shoe completely unzipped.

The main parts of the shoe consist of the upper, the heel, and the bottom. The upper consists of the vamp 1 and the toe cap 2, shown in FIG. 2A, with part of the medial side of the vamp being connected to the heel. The lateral side of the vamp is detached from the outside of the ankle to the outsole at the base of the big toe, as shown in FIG. 1 and FIG. 3. The heel consists of the center of the heel 3 and the quarter 4, shown in FIG. 1, and FIGS. 2A and 2B. The medial side of the quarter 4 is connected to the upper. The lateral side of the quarter 4 is split from the ankle part to the edge of the outsole. The collar 5 is attached around the edges of heel and the vamp 1 so that it surrounds the ankle when the vamp is attached to the quarter. At the center of the edge of the heel 3 is a tab with a loop that is large enough to insert a finger. The bottom consists of the outsole 7 and the outsole toe 8. The slide fastener 9 is attached horizontally along the edge of the upper and along the edge of outsole from the base of the big toe to the outside of the ankle.

Figure 2B:
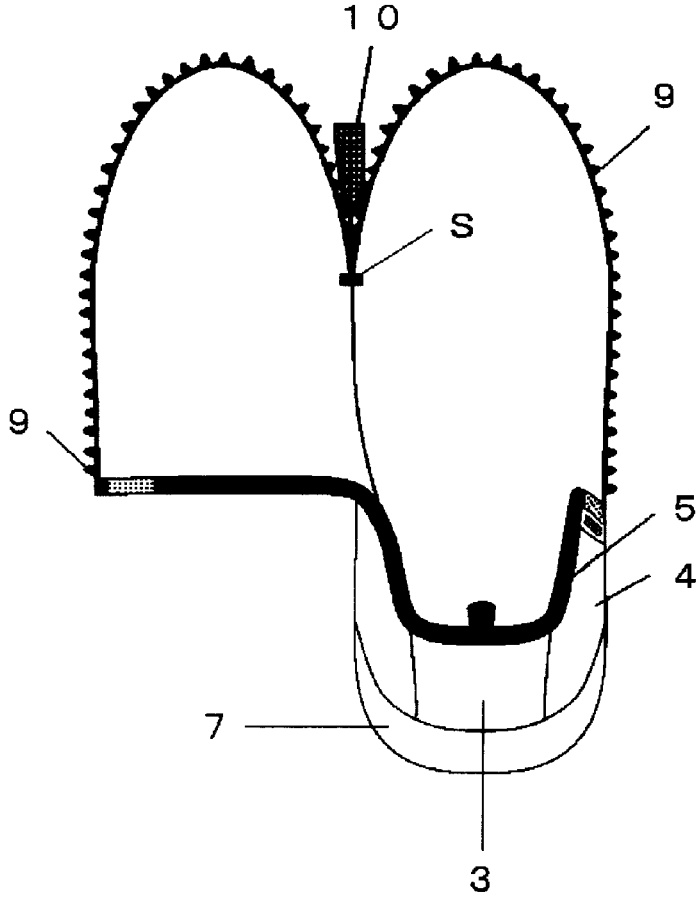
Figure 3:
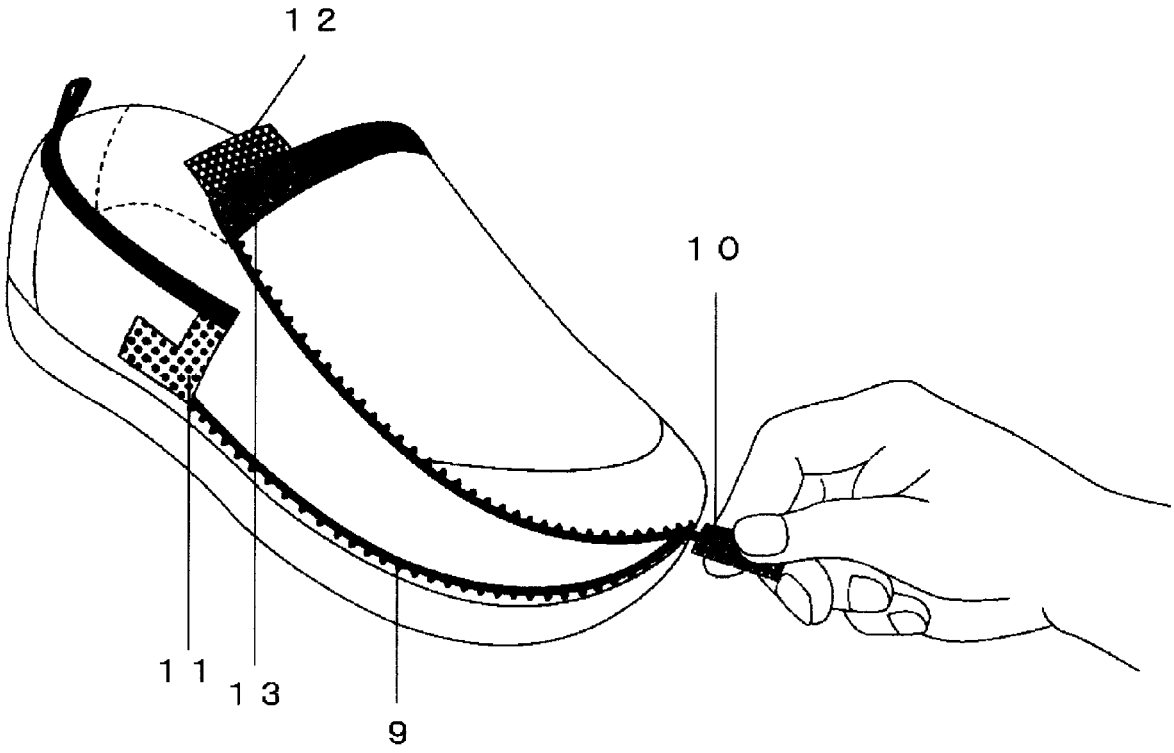
FIG. 3 is an oblique view of a right shoe in Embodiment 1 of the present invention, showing the shoe's slide fastener half-unzipped or half-zipped to the middle of the toes.

The first fastening tape 10 (hook strip) is attached to the pull-tab of slide fastener 9, as shown in FIG. 1, FIG. 2B, and FIG. 3.

Figure 4A:
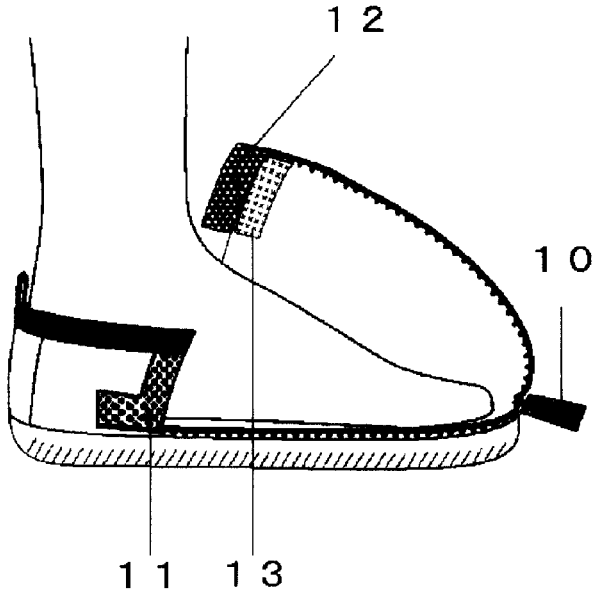
FIG. 4 a side view 4A of a right shoe in Embodiment 1 of the present invention in which a foot has been placed and showing the slide fastener half-unzipped or half-zipped to the middle of the toes, and a side view 4B of the foot in the shoe with the shoe's slide fastener zipped and its fastening tapes fixed.
Figure 4B:
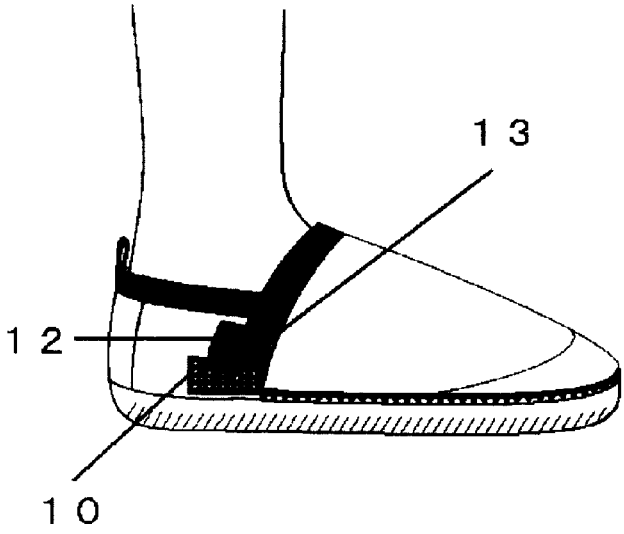

The second fastening tape 11 (loop strip) is attached at the quarter in line with the first fastening tape, as shown in FIG. 1, FIG. 3, and FIG. 4A.

The third fastening tape 12 (hook strip) is attached at the outside medial edge of the upper, as shown in FIG. 1, FIG. 3, and FIGS. 4A and 4B. A seam allowance 13 for the third fastening tape 12 is attached underneath the outside medial edge of the upper.

The insole 14 is set on top of the outsole of the shoe, inside the shoe bottom.

Using the above-described structure, Embodiment 1 of the present invention is a shoe with a slide fastener that zips open horizontally along the edge of the upper so that the upper may be completely open, as shown in FIG. 2B.

A further description of Embodiment 1 is as follows:

The vamp 1 of the upper is a single layer of Neoprene™ composite.

The toe cap 2 is designed using the Neoprene™ composite that is used in the vamp 1 of the upper. The Neoprene™ composite is sewn to the toe cap, and is a different color and texture than that of the vamp 1 of the upper. Also, in contrast to the single layer used in the vamp 1 of the upper, the toe cap 2 of the upper has two layers.

In the heel, the center of heel 3 is comprised of three layers: a hard urethane sponge pad sandwiched by Neoprene™ composite on the inside and outside. The quarter 4 is also three layers comprised of a hard urethane sponge pad that is thinner than the sponge pad of the center of heel 3 and that is sandwiched by Neoprene™ composite on the inside and outside.

The collar 5 that is attached around the edges of the heel and the vamp 1 consists of Neoprene™ composite that is covered by a bias tape made of synthetic suede. Thus, when the vamp is attached to the quarter, the ankle is surrounded by the collar 5 of soft, synthetic suede.

The height of the heel part is sufficient to cover the Achilles' tendon.

The above-described structure helps to maintain the shape of the heel and also lends a reassuring sense the shoe fits the foot well.

In the shoe bottom, the thickness of the toe portion 8 of the outsole is made thinner to the extent possible than the thickness of the outsole portion 7. The outsole portion 7 is made flat, and the shoe bottom is provided with an edge portion of prescribed height. The thinner toe portion 8 of the outsole helps provide balance for the wearer. The flat outsole 7 helps provide the wearer with a sense of stability, thus decreasing the fear of falling. The flat outsole 7 also makes the bottom of the shoe thin and light, which is more comfortable. The bottom of the shoe is molded with transparent silicon rubber into the above-described shape.

The insole 14 consists of the insole core 15 and the insole cover 16. The insole core 15 is made of a hard plastic and along its underside has a heel area gently sloping rearward. The insole cover 16 is made of washable cotton and is removable from the insole core.

Figure 5A:
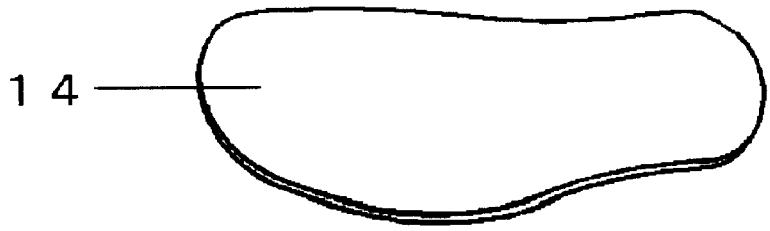
FIG. 5 includes an oblique view 5A, a longitudinal sectional view 5B, and transverse sectional view 5C of the insole in Embodiment 1 of the present invention.
Figure 5B:
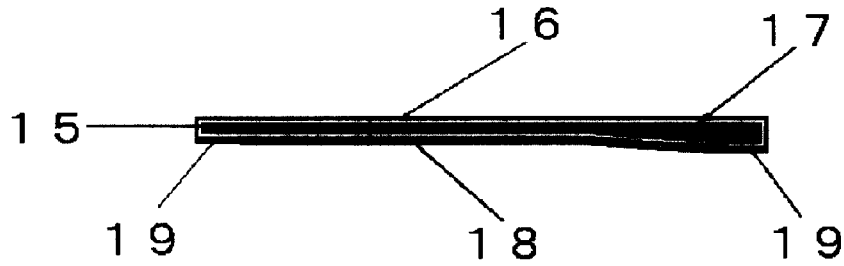
Figure 5C:
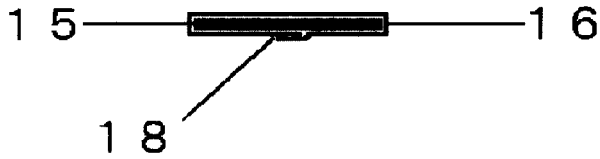

In Embodiment 1, as shown in FIGS. 5B and 5C, the insole cover 16 is provided with an insole-core insertion/removal mouth 18 formed by longitudinally overlapping portions of the bottom of the insole cover 16, and at the front and rear portions of the bottom is provided with margins 19 for sewing in the insole cover.

The production process for Embodiment 1 is as follows:

(1) First, the upper and the heel are made by cutting at the outer edge from the ankle to the edge of outsole.

(2) Second, one side of the seam allowance for the slide fastener is glued with the material for the inside of the outsole, from the base of the big toe to the ankle at the edge of the upper.

(3) Third, the other side of the seam allowance for the slide fastener is sewed horizontally to the upper along the inside of outsole, in line with the first side sewn, from the edge of the upper at the base of the big toe to the ankle.

(4) Fourth, the slider for the slide fastener is engaged after the upper and the heel are sewn with the material for the inside of outsole.

(5) The bottom of the shoe is molded into the prescribed shape with transparent silicon rubber.

(6) The upper part, consisting of the upper and the heel prepared by processes (1)–(4) above, and the bottom are put together, and the material for the inside of insole and outsole are glued so as to hide the seam allowance of the material and the glued part at the edge of the outsole.

(7) Finally, the insole 14, prepared separately, is put onto the material for the inside of insole.

The above production process may be completed in a different order than the order described.

The figures for Embodiment 1 are described as follows:

FIG. 1 is an oblique side view of a right shoe in Embodiment 1 of the present invention, showing the upper of the shoe half-unzipped to the middle of the toes.

FIG. 2 includes an oblique view 2A of the left side of the right shoe in Embodiment 1 of the present invention, and an oblique view 2B of the top of the shoe, showing the shoe completely unzipped.

FIG. 3 is an oblique view of a right shoe in Embodiment 1 of the present invention, showing the shoe's slide fastener half-unzipped or half-zipped to the middle of the toes.

FIG. 4 includes a side view 4A of a right shoe in Embodiment 1 of the present invention in which a foot has been placed, showing the slide fastener half-unzipped or half-zipped to the middle of the toes, and a side view 4B of the foot in the shoe with the shoe's slide fastener zipped and its fastening tapes fixed.

FIG. 5 includes an oblique view 5A, a longitudinal sectional view 5B, and transverse sectional view 5C of the insole in Embodiment 1 of the present invention.

Embodiment 2

Figure 6:
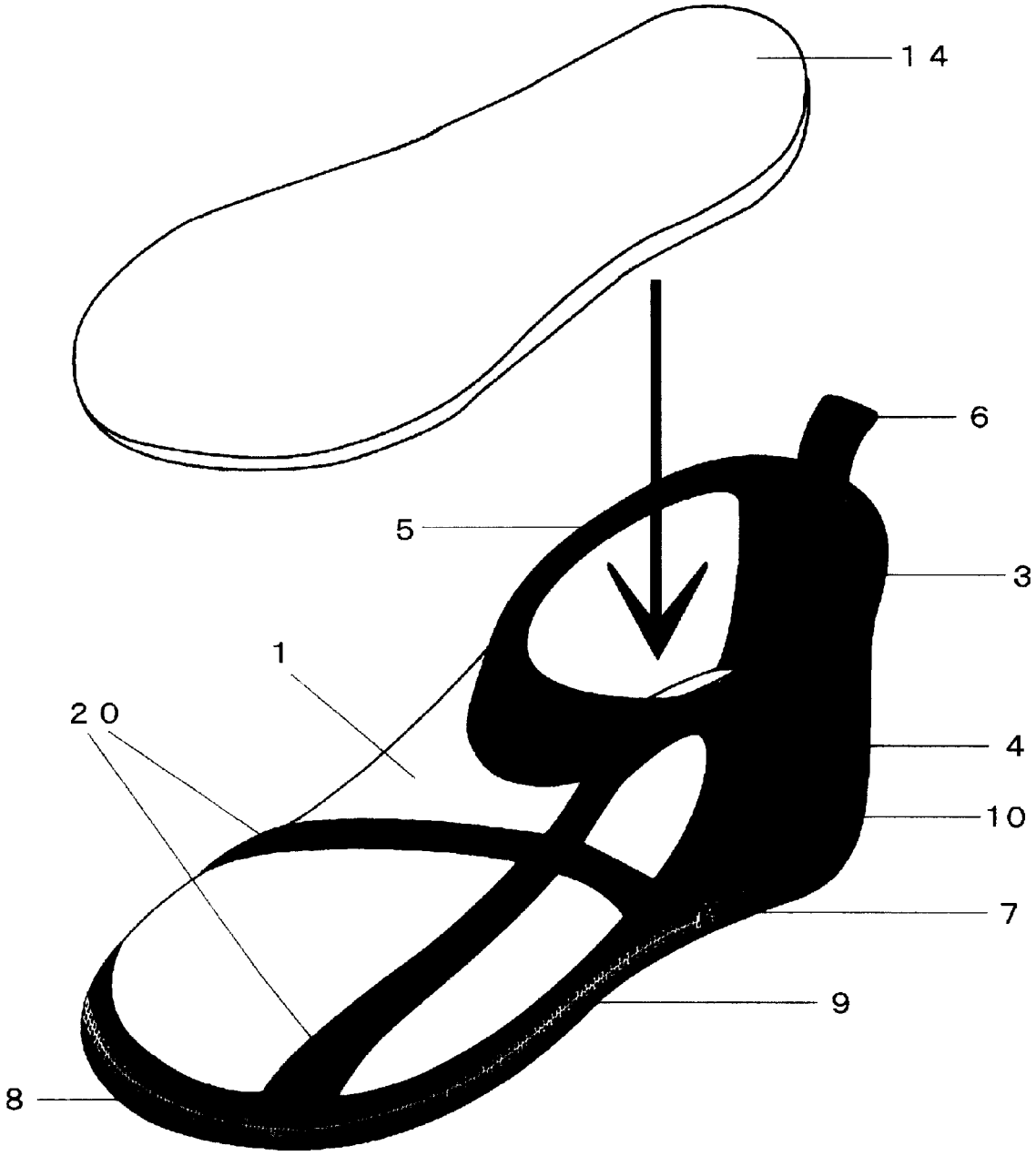
FIG. 6 includes an oblique view of the left side of a right shoe in Embodiment 2 of the present invention and an oblique view of the insole.
Figure 7A:
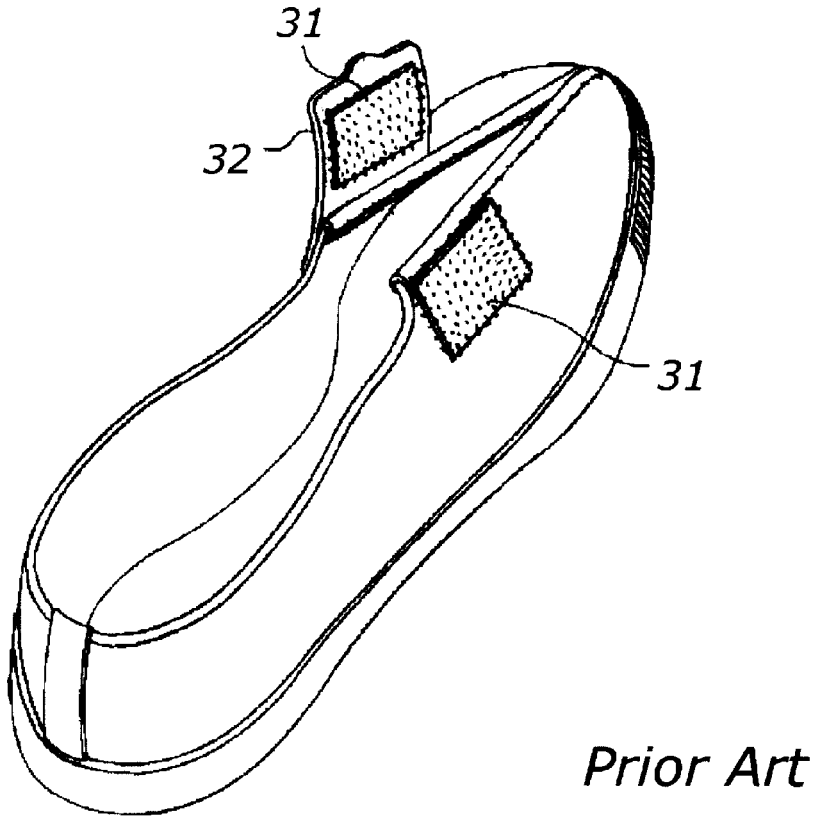
FIG. 7 includes an oblique view 7A showing a shoe in a first conventional example with a first fastening tape attached to the underside of the belt and another first fastening tape attached to the vamp in line with the tape on the belt in order to open and close the shoe, and an oblique view 7B showing the shoe on a foot.
Figure 7B:
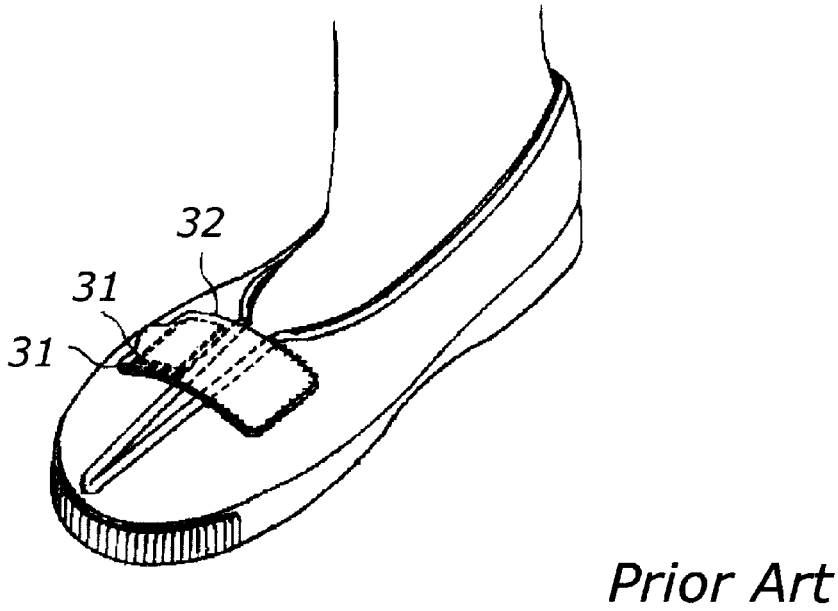
Figure 8A:
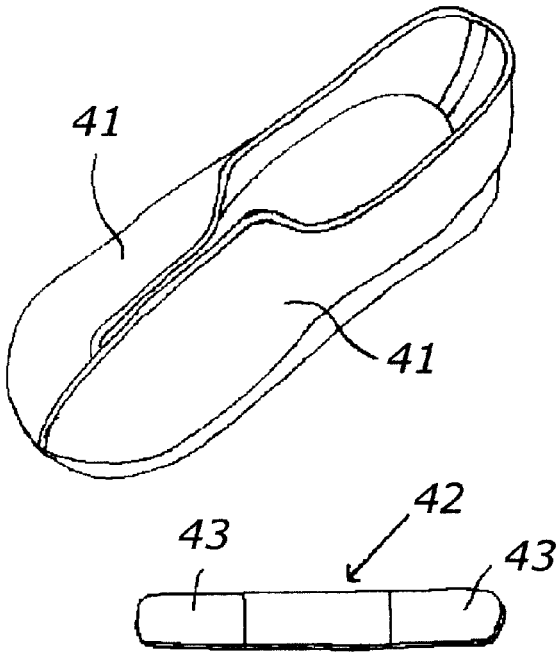
FIG. 8A Prior Art
FIG. 8 includes an oblique view 8A showing a shoe in a second conventional example with a vamp that functions as a fastening tape, and a separate fastening belt with a first fastening tape attached to its underside, and an oblique view 8B showing a foot in the shoe with the fastening belt fastened.
Figure 8B:
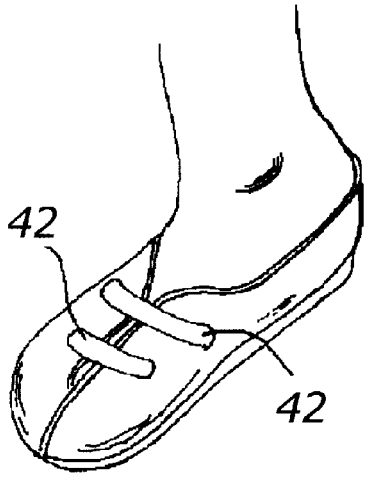
Prior Art FIG. 8B
Figure 9:
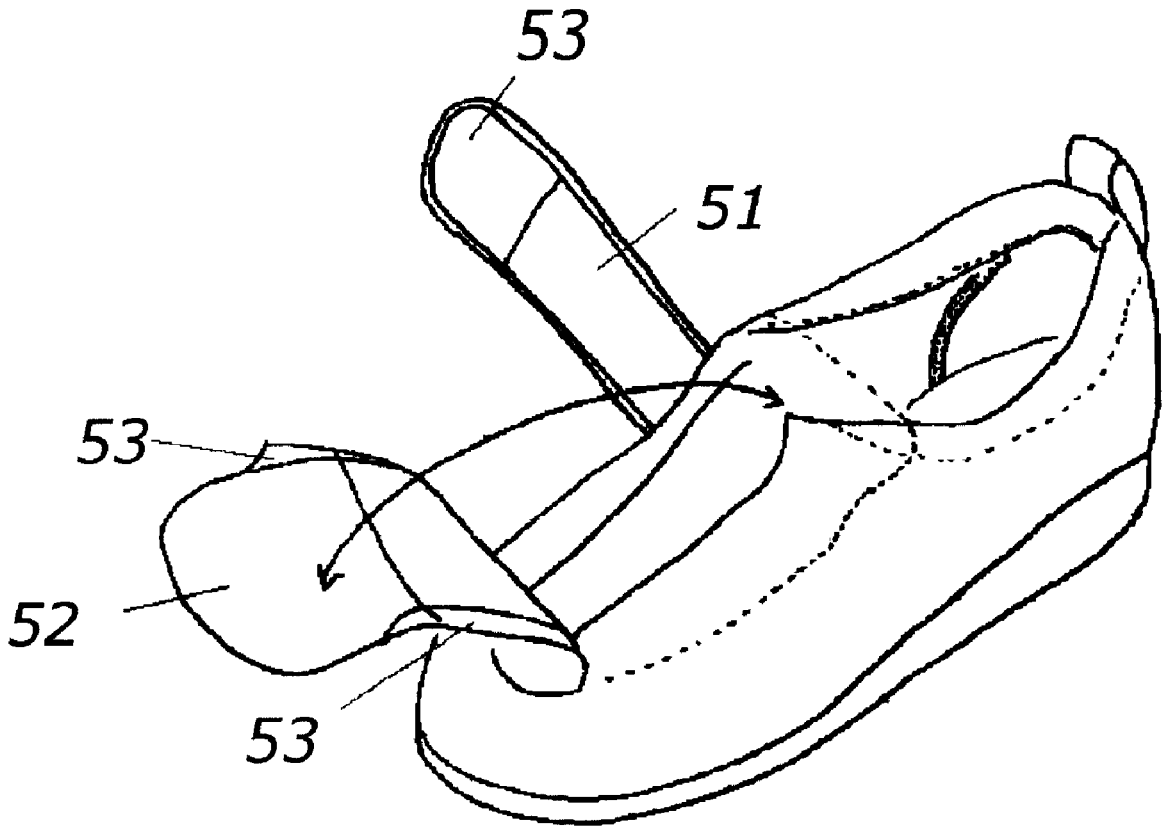
Prior Art FIG. 9
FIG. 9 is an oblique view of a shoe in a third conventional example, showing a shoe having a partially slit vamp that functions as a hook-and-pile fastener surface, with a belt and a flap with hook-and-pile first fastening tape attached to the underside of the flap and the belt.
Figure 10A:
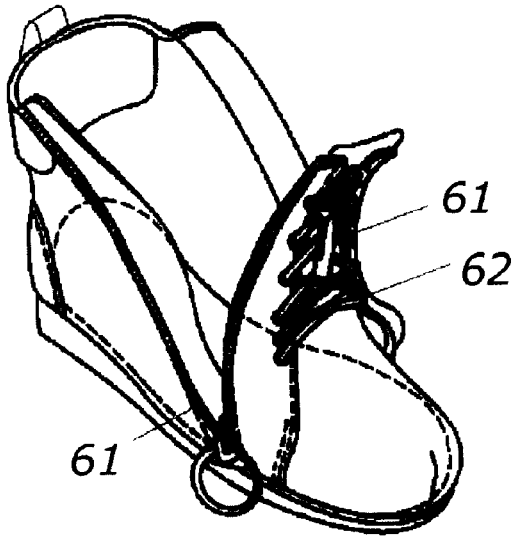
Prior Art FIG. 10A
FIG. 10 includes an oblique view 10A showing a shoe in a fourth conventional example with slide fasteners at both sides of the shoelaces, an oblique view 10B showing the shoe with a slide fastener unzipped to open out the cuff, and an oblique view 10C showing the slide fastener being fastened.
Figure 10B:
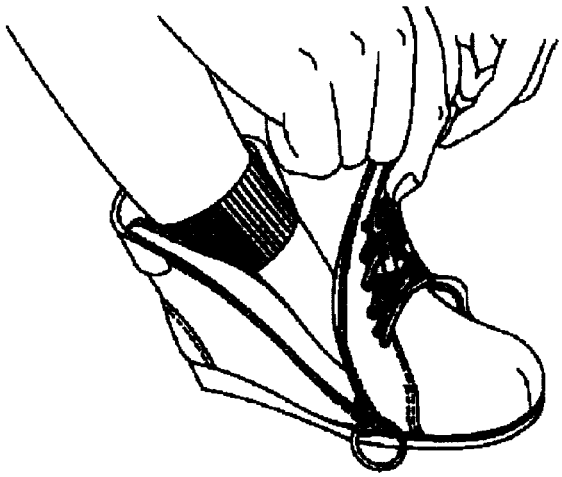
Prior Art FIG. 10B
Figure 10C:
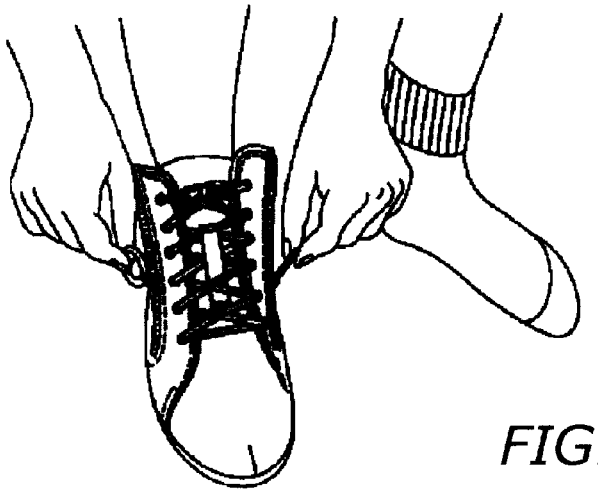
Prior Art FIG. 10C

FIG. 6 is an oblique view of a right shoe in Embodiment 2 of the present invention.

The shoe in Embodiment 2 in provided with an ornament 20 in which two strips of cloth are sewn on running from the vamp 1 to the toe at the upper, and in which the same Neoprene™ composite material as the upper, but in a different color and with a different texture, is sewn to the center of heel 3, the quarter 4, the collar 5, the tab 6, and, in addition, the outsole 7 and the toe of outsole 8. The structure of the shoe in Embodiment 2 is almost the same as the shoe in Embodiment 1, but the shoe in Embodiment 2 has a focus on a fashionable look. The shoe in Embodiment 2 helps to bring fashion into the nursing care environment, an environment that traditionally has had a negative image. Accordingly, the shoe in Embodiment 2 helps to change the image of nursing care by helping to make those who receive nursing care more fashionable, which may brighten the mental state of nursing care recipients and help to make the care itself more effective.

As above noted, the present invention has the following advantages:

(1) The shoe has a slide fastener attached horizontally along the edge of the outsole that zips open from the outside edge of the shoe to the big toe on the inside edge, thus permitting the upper to fully open. Therefore, the wearer may easily put on the shoe by simply placing the foot on the insole of the shoe. The slide fastener can be zipped open, even with one hand.

(2) The shoe combines the slide fastener with fastening tape to enable the wearer to put on and remove the shoe easily and also to hold the foot firmly in the shoe.

(3) Neoprene™ composite is used as the material for the upper, which gives the upper excellent water resistance, a water-shedding quality, elasticity, flexibility and breathability.

(4) Given the diversity of Neoprene™ composite on the market, it can be used to make a fashionable shoe. Therefore, the shoe helps to change the image of nursing care by helping to make those who receive nursing care more fashionable, which may brighten the mental state of nursing care recipients and help to make the care more effective.

(5) The insole consists of the insole core and the insole cover. The bottom of the insole core is made of a hard plastic that along its underside has a heel area gently sloping rearward. Therefore, the shoes fit comfortably.

(6) The insole cover is removable and is made of cotton, so that it is as washable as a pair of socks. In addition, the plastic insole core can be easily wiped with a damp cloth. These features enable wearers and care-givers to keep the shoes clean, particularly when the shoes are worn for long periods of time by nursing care recipients.

(7) In addition, the shoes use a slide fastener with a water-resistance of 0.01 kgf/cm$^2$ or more, enabling the shoe to resist water on rainy days, even though the slide fastener is attached horizontally at the bottom edge of the shoe.

Only selected embodiments have been chosen to illustrate the present invention. To those skilled in the art, however, it will be apparent from the foregoing disclosure that various changes and modifications can be made herein without departing from the scope of the invention as defined in the appended claims. Furthermore, the foregoing description of the embodiments according to the present invention is provided for illustration only, and not for limiting the invention as defined by the appended claims and their equivalents.

What is claimed is:

1. A shoe comprising:

a sole:

an upper defining a quarter, a collar, and a vamp having a toe cap, said quarter being permanently attached to said sole and only unilaterally continuous with said vamp, said vamp being split from and extended to overlap said quarter down one side of said upper, from the collar to the sole, and said upper being horizontally split along said sole starting in a start position on the vamp in the area for the ball of the big toe, running along the toe cap, and reaching, in an end position, to where the vamp is split from the quarter, said upper being made of a flexible material said vamp is;

a zipper provided along said horizontal split, extending from the start to the end position, such that said zipper lies substantially in only a single plane, said zipper having a pull-tab functioning to close the split between the vamp and the quarter;

a first hook-and-pile fastener provided on said pull-tab; and a second hook-and-pile fastener complementary to said first hook-and-pile fastener, provided on said quarter alongside where said vamp splits from said quarter; the shoe therein structured so that said vamp falls open under its own weight when unzipped off said sole, so that the shoe may be stepped into without obstructing the wearer's foot, and the shoe can be fastened securely onto the wear's foot in a single-stroke, in-plane operation of zipping said vamp from the start position onto the sole to close said vamp over the wearer's foot, and on reaching the end position, closing the pull-tab onto said quarter to engage said first and second hook-and-pile fasteners, thereby closing said vamp completely onto said quarter along the split therebetween, without zipping in any direction orthogonal or oblique to said single plane in which said zipper lies.

2. A shoe comprising:

a sole;

an upper defining a quarter, a collar, and a vamp having a toe cap, said quarter being permanently attached to said sole and only unilaterally continuous with said vamp, said vamp being split from said quarter down one side of said upper, from the collar to the sole, and said upper being horizontally split along said sole starting in a start position on the vamp in the area for the bail of the big toe, running along the toe cap, and reaching, in an end position, to where the vamp is split from the quarter, said upper being made of a flexible material;

a zipper provided along said horizontal split, extending from the start to the end position, such that said zipper lies substantially in only a single plane, said zipper having a pull-tab functioning to close the split between the vamp and the quarter;

a first hook-and-pile fastener provided on said pull-tab; and second and third hook-and-pile fasteners, said second hook-and-pile fastener being complementary to said first and third hook-and-pile fasteners, and provided on said quarter alongside where said vamp splits from said quarter, and said third hook-and-pile fastener being provided extending from said vamp, for overlying said second hook-and-pile fastener, whereby said first hook-and-pile fastener and said third hook-and-pile fastener are fastenable to said second hook-and-pile fastener to close said vamp onto said quarter; the shoe therein structured so that said vamp falls open under it's own weight when unzipped off said sole, so that the shoe may be stepped into without obstructing the wearer's foot, and the shoe can be fastened securely onto the wear's foot in a single-stroke, in-plane operation of zipping said vamp from the start position onto the sole to close said vamp over the wearer's foot, whereby said third hook-and-pile fastener engagingly overlies said second hook-and-pile fastener, and on reaching the end position closing the pull-tab onto said quarter to engage said first and second hook-and-pile fasteners, thereby closing said vamp completely onto said quarter along the split therebetween, without zipping in any direction orthogonal or oblique to said single plane in which said zipper lies.

3. A shoe for the elderly and disabled, the shoe comprising:

a sole defining a heel area and a toe area, said toe area being thinner to the extent possible than the heel area;

an upper defining a quarter, a collar, and a vamp having a toe cap, said quarter being permanently attached to said sole and only unilaterally continuous with said vamp, said vamp being split from said quarter down one side of said upper, from the collar to the sole, and said upper being horizontally split along said sole starting in a start position on the vamp in the area for the ball of the big toe, running along the toe cap, and reaching, in an end position, to where the vamp is split from the quarter, said upper being made of a flexible material when said vamp is;

a zipper provided along said horizontal split, extending from the start to the end position such that said zipper lies substantially in only a single plane, said zipper having a pull-tab functioning to close the split between the vamp and the quarter;

a first hook-and-pile fastener provided on said pull-tab; and second and third hook-and-pile fasteners, said second hook-and-pile fastener being complementary to said first and third hook-and-pile fasteners, and provided on said quarter alongside where said vamp splits from said quarter, and said third hook-and-pile fastener being provided extending from said vamp, for overlying said second hook-and-pile fastener, whereby said first hook-and-pile fastener and said third hook-and-pile fastener are fastenable to said second hook-and-pile fastener to close said vamp onto said quarter; the shoe therein structured so that said vamp falls open under its own weight when unzipped off said sole, so that the shoe may be stepped into without obstructing the wearer's foot, and the shoe can be fastened securely onto the wear's foot in a single-stroke, in-plane operation of zipping said vamp from the start position onto the sole to close said vamp over the wearer's foot, whereby said third hook-and-pile fastener engagingly overlies said second hook-and-pile fastener, and on reaching the end position closing the pull-tab onto said quarter to engage said first and second hook-and-pile fasteners, thereby closing said vamp completely onto said quarter along the split therebetween, without zipping in any direction orthogonal or oblique to said single plane in which said zipper lies.

4. A shoe as set forth in claim 1, wherein said upper is made of a composite material composed of polychloroprene rubber foam to at least one side of which a synthetic fabric is laminated.

5. A shoe as set forth in claim 2, wherein said upper is made of a composite material composed of polychloroprene rubber foam to at least one side of which a synthetic fabric is laminated.

6. A shoe as set forth in claim 3, wherein said upper is made of a composite material composed of polychloroprene rubber foam to at least one side of which a synthetic fabric is laminated.

7. A shoe as set forth in claim 1, further comprising an insole, said insole including:

an insole core made of a hard plastic material, said insole core along its underside having a heel area gently sloping rearward, said insole core therein being slightly thicker in its rearward portion; and an insole cover made of a washable fabric and removable from said insole core.

8. A shoe as set forth in claim 2, further comprising an insole, said insole including:

an insole core made of a hard plastic material, said insole core along its underside having a heel area gently sloping rearward, said insole core therein being slightly thicker in its rearward portion; and an insole cover made of a washable fabric and removable from said insole core.

9. A shoe as set forth in claim 3, further comprising an insole, said insole including:

an insole core made of a hard plastic material, said insole core along its underside having a heel area gently sloping rearward, said insole core therein being slightly thicker in its rearward portion; and an insole cover made of a washable fabric and removable from said insole core.

10. A shoe as set forth in claim 1, wherein said zipper has a water resistance of 0.01 $kgf/cm^2$ or greater.

11. A shoe as set forth in claim 2, wherein said zipper has a water resistance of 0.01 $kgf/cm^2$ or greater.

12. A shoe as set forth in claim 3, wherein said zipper has a water resistance of 0.01 $kgf/cm^2$ or greater.

13. A shoe composed of an upper, a heel portion, and a sole portion, with the heel portion being made up of a heel center portion and heel side portions, the upper section being horizontally openable/closable by means of a slide fastener, the shoe characterized in that;

the heel side portion along the inside part of the foot is continuous with the shoe upper, and the heel side portion along the outside part of the foot from the ankle-joint part to the insole pad of the foot instep splits away, splitting the outer side of the upper, the split-away part of the upper where it splits from the heel side portion along the outside part of the foot including a seam allowance for overlapping the heel side portion along the split;

a third hook-and-pile fastener is provided on obverse/reverse sides of the seam allowance along the split-away part of the upper;

a slide fastener splits the upper horizontally, and at the same time is provided on the horizontally splitting part of the upper, running along the insole from a position in the portion of the upper where the ball of the big toe is, passing along the toe cap, and reaching to the position of the ankle-joint split in the foot instep such that said slide fastener lies substantially in only a single plane, said slide fastener having a pull-tab functioning to close the split between the heel side portion and the upper;

a first hook-and-pile fastener is provided on said pull-tab; and a second hook-and-pile fastener is provided on a heel-side-portion surface for receiving the first hook-and-pile fastener; wherein at the finish of a single-stroke, in-plane operation of closing the slide fastener, the second hook and pile fastener on the heel side portion, the third hook-and-pile fastener on the split-away part of the upper, and the first hook-and-pile fastener on the slide fastener pull-tab fasten together to close the heel side portion completely onto the upper, whereby the shoe is fastened securely onto the wearer's foot.

* * * * *